US006213867B1

(12) United States Patent
Yazici et al.

(10) Patent No.: US 6,213,867 B1
(45) Date of Patent: Apr. 10, 2001

(54) VENTURI TYPE AIR DISTRIBUTION SYSTEM

(75) Inventors: Muammer Yazici, Etobicoke (CA); Tom Fisher, Nashville, TX (US); Gerhard Granek, North York (CA)

(73) Assignee: Air Handling Engineering Ltd., Buffalo, NY (US)

( * ) Notice: Subject to any disclaimer, the term of this patent is extended or adjusted under 35 U.S.C. 154(b) by 0 days.

(21) Appl. No.: 09/481,797

(22) Filed: Jan. 12, 2000

(51) Int. Cl.[7] ..... F24F 13/04
(52) U.S. Cl. ..... 454/263; 454/261
(58) Field of Search ..... 454/261, 263, 454/234, 228

(56) References Cited

U.S. PATENT DOCUMENTS

| | | |
|---|---|---|
| 1,138,470 | 5/1915 | Hackney . |
| 4,672,887 | 6/1987 | Sproul . |
| 5,324,229 | 6/1994 | Weisbecker . |
| 5,350,337 | 9/1994 | Kondo et al. . |
| 5,577,958 | 11/1996 | Kumekawa et al. . |

OTHER PUBLICATIONS

M & I Induction Unit Brochure, 1996, pp. 1 to 3,8 to 10, 13, 14.

*Primary Examiner*—Harold Joyce
*Assistant Examiner*—Derek S. Boles
(74) *Attorney, Agent, or Firm*—Baker & Daniels

(57) ABSTRACT

An air handling system for an enclosed space in a building includes two induction units that can be mounted above a ceiling. Each unit has an elongate air plenum section and an air mixing section forming an air mixing chamber. Air nozzles extend into the air mixing chamber and are mounted on a side of the air plenum section. Each nozzle has an inlet end opening into an interior chamber of the plenum section. Each air mixing section has an air outlet formed at a lower end thereof and a side air inlet for permitting return air to flow into the mixing chamber. Each induction unit is mounted so that the air mixing section extends at a substantial acute angle to the ceiling with the air outlet positioned where the mixing section meets the ceiling. The return air is drawn by a venturi effect created by the nozzles into each mixing chamber.

19 Claims, 5 Drawing Sheets

VENTURI TYPE AIR DISTRIBUTION SYSTEM

BACKGROUND OF THE INVENTION

This invention relates to an air handling system for a building and, in particular, such a system employing one or more induction units adapted to mix two air flows.

A variety of air handling systems for both large and small buildings are already known in the air handling industry. Air handling systems both for residential and commercial buildings can include the use of a central heating system that includes a fan unit capable of blowing heated air through air ducts that deliver the air to the various rooms of the building. When this system is used in conjunction with a central air conditioner, it is also capable of providing cool air to the various rooms through the air ducts. A relatively large fan is generally required for a large commercial or industrial building. Air silencers can be installed on both the inlet side and outlet side of these large fans to reduce the noise levels created by the operation of such fans.

It is also known to provide so called induction units that employ the venturi effect to mix together both return air from a building and primary air. The two air flows are mixed in a mixing chamber located adjacent an elongate air plenum with a primary air inlet at one end. Tapered nozzles extend into the mixing chamber and are connected to a wall of the air plenum. The return air from serviced space enters the mixing chamber which is flanked by the induction unit's coils on one side and five sides of the enclosure of the unit. There is an opening on the sixth side of the enclosure for entry of the return air. These units can typically be mounted on a wall of a room with the air plenum section located near the floor and the air outlet located at the top of the unit. Such induction units have at least several advantages including the ability to operate at very low noise levels since they do not employ any fans or similar air circulating devices. They can also be used in conjunction with both high pressure as well as low pressure air duct systems and they provide for a reasonably efficient mixing of the primary air and the return air.

Systems for delivering treated air to a room through an outlet located in the ceiling are already known. For example, U.S. Pat. No. 4,672,887 which issued Jun. 16, 1987 to Fred Sproul Sr. describes an air delivery system located above a horizontal ceiling in a dwelling. The air duct system delivers treated air to a valance/diffuser air system that can be located adjacent one wall of the dwelling. The conditioned or treated air is forced into the air delivery system by a blower of a conditioning unit such as a forced air furnace. At the wall the air is initially distributed lengthwise along an elongate horizontal chamber and then distributed through apertures in a downwardly direction. However, this known system does not use air induction units for mixing return air and primary air. In this known system the return air system is located beneath the floor of the dwelling.

More recent U.S. Pat. No. 5,577,958 issued to Mitsubishi Denki Kabushiki Kaisha in November, 1996 describes a ceiling-embedded cassette type air conditioner located above a decorative grate or panel through which return air can pass. A blower is located centrally in this air conditioner and it forces the return air through two or more heat exchangers located on the perimeter of the blower. The conditioned air is returned to the room through two or more outlets located at the ceiling level. Air directing plates can be positioned in the air outlets and these can direct the outflowing air to flow into the room at an angle to the horizontal. This known air conditioning system does not employ any induction unit that relies on the venturi effect and, because it employs a blower, it will be quite noisy when it is operating.

It is an object of the present invention to provide an air handling system for a building which employs at least two induction units and which is capable of mixing return air and primary air efficiently and quietly.

It is a further object of the present invention to provide an air handling apparatus for a building that includes two induction units, which apparatus can be manufactured and installed at a reasonable cost and can be operated and maintained at a low cost.

SUMMARY OF THE INVENTION

According to one aspect of the invention, an air handling system for a building having a horizontally extending ceiling and an enclosed space below this ceiling includes two induction units adapted for mounting adjacent the ceiling, each unit having an air mixing section forming a relatively long air mixing chamber and an elongate horizontally extending air plenum section mounted at an upper end of the air mixing chamber and having a primary air inlet formed therein. Air nozzles extend into the air mixing chamber of each unit and are mounted on a side of the air plenum section. Each air nozzle has an inlet end that is open to an interior chamber of the air plenum section. The air mixing section has an air outlet formed at a lower end thereof and a side air inlet for permitting return air to flow through a side of the air mixing section and into the air mixing chamber. Supporting members are also provided for mounting the two induction units so that each air mixing section extends at a substantial acute angle to the ceiling and is located adjacent the ceiling. During use of this system, the return air is drawn by the venturi effect created by the nozzles into each air mixing chamber. Each induction unit is capable of delivering a mixture of primary air, that passes through the plenum section and the nozzles, and return air through its air outlet to the enclosed air space.

Preferably a heat exchanging coil unit is mounted adjacent to the side of at least one air mixing section so that return air flowing through the side air inlet first passes through the coil unit in order to be heated or cooled thereby.

According to a further aspect of the invention, there is provided a combination of a building structure having an enclosed space and an air handling system capable of providing a mixture of primary air and return air to the enclosed space. This combination includes a horizontally extending ceiling and walls forming the building structure and defining the enclosed space. Two induction units are mounted adjacent the ceiling and each unit has an air plenum section with a primary air inlet and an air mixing section forming an air mixing chamber and mounted on a side of the air plenum section. Air nozzles extend into each air mixing chamber and are mounted on the side of the air plenum section. These air nozzles each have an inlet end that is open to a primary air high pressure plenum chamber in the air plenum section. A side return air inlet in one side of the air mixing section permits return air to flow into the air mixing chamber from the enclosed space. Each air mixing section has an air outlet at an end thereof furthest from its plenum section. There are also supporting frame members mounting the two induction units adjacent the ceiling so that each air mixing section extends down from the air plenum section to its air outlet and extends at an acute angle to the ceiling. During use of this system, the return air from the enclosed space is drawn by a venturi effect created by the nozzles into each air mixing chamber and the two induction units deliver the mixture of primary air and return air through their air outlets to the enclosed space.

Further features and advantages will become apparent from the following detailed description of a preferred embodiment, taken in conjunction with the accompanying drawings.

DETAILED DESCRIPTION OF PREFERRED EMBODIMENTS

Figure 1:
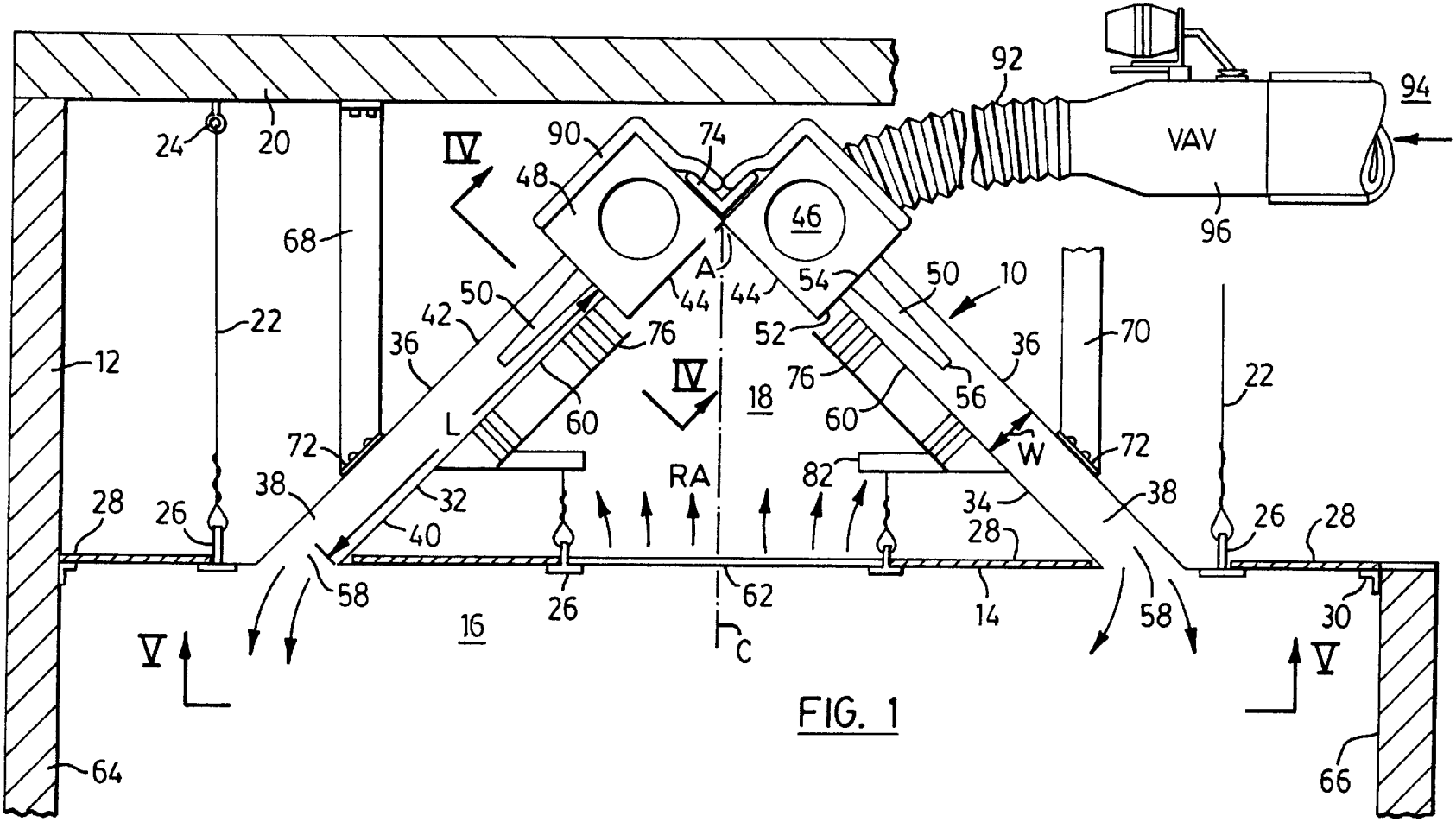
FIG. 1 is a cross-sectional elevation illustrating the preferred air handling system constructed in accordance with the invention.

A preferred air handling system 10 constructed in accordance with the invention is illustrated in FIG. 1. This system is designed for a building 12 only a portion of which is shown for ease of illustration, this building having a generally planar ceiling 14 and an enclosed space 16, for example, a room, below the ceiling. The preferred illustrated ceiling 14 is the type commonly referred to as a suspended ceiling that forms an enclosed space 18 between itself and a rigid structural or supporting ceiling 20 that may, for example, be made of concrete. The illustrated suspended ceiling is supported by vertically extending support wires 22 in a well known manner. The support wires 22 can extend up to the structural ceiling 20 and can be firmly attached thereto by any known mechanism, for example, the loop connector 24 shown. The wires 22 are commonly connected at the bottom end to a T-bar ceiling grid comprising a number of T-bar members 26. Generally these T-bar members extend both longitudinally and widthwise of the room, although, for ease of illustration, the illustrated T-bars 26 are extending in only one direction. The T-bars support a number of standard ceiling panels 28 which can be of a standard length and width and, if necessary, cut to fit the required area. The outer perimeter panels 28 can be supported at their outer edges by any known means, such as by the illustrated angle members 30, or by simply placing the edge of the panel on the top of the adjacent wall.

The preferred air handling system 10 includes two induction units 32 and 34, each adapted for mounting above the ceiling 14. Each induction unit 32, 34 has an air mixing section 36 forming a relatively long air mixing chamber 38. As illustrated in FIG. 1, the length of the air mixing chamber is indicated by the distance marked L and is the length of the shorter of two parallel sidewalls 40 and 42. It will be seen that the length L is relatively long compared to the narrow width W of the chamber. Preferably the air mixing chamber also has a substantial depth taken in a direction perpendicular to the cross-sectional plane illustrated in FIG. 1. The substantial depth of the air mixing chamber can be more clearly seen from FIGS. 2 and 5.

Figure 2:
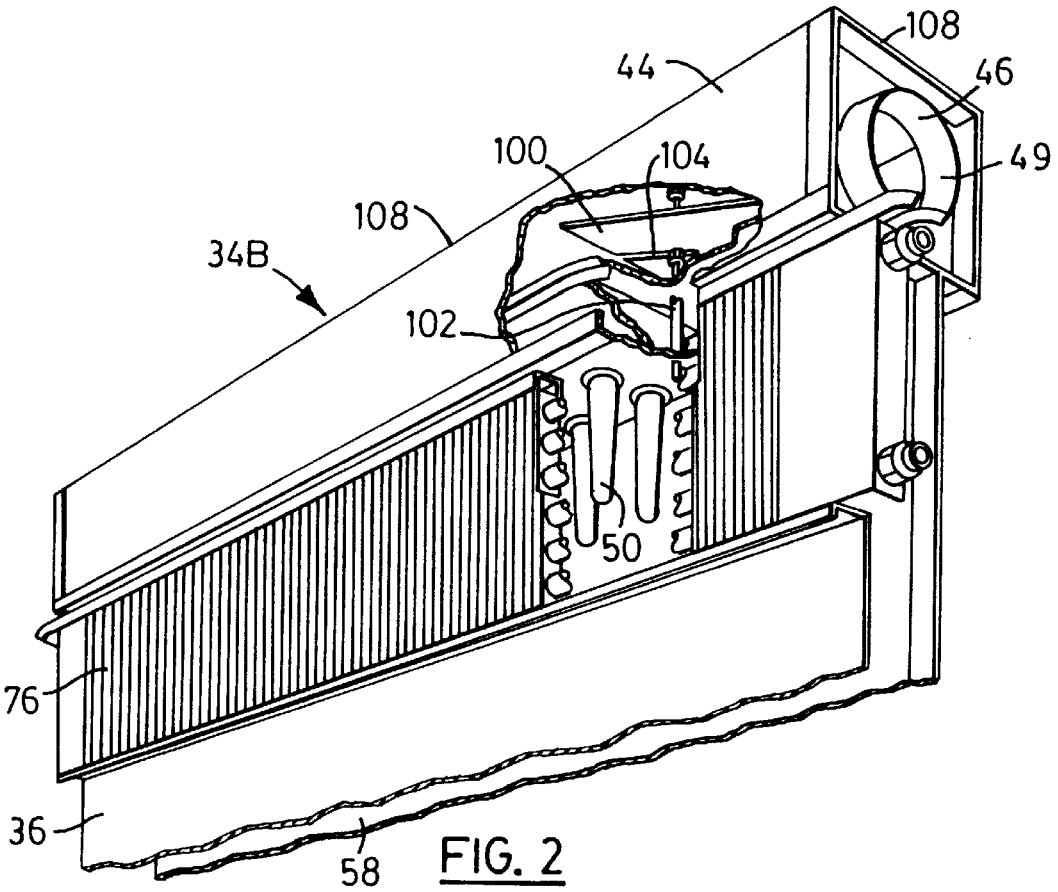
FIG. 2 is a perspective view of an induction unit of the type that can be used in the air handling system of FIG. 1.
Figure 3:
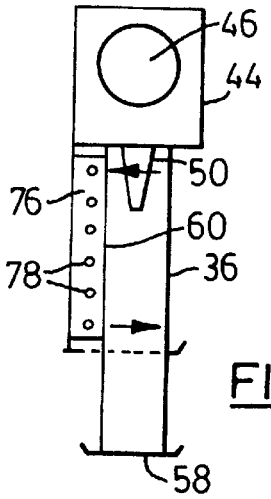
FIG. 3 is a schematic end view of the induction unit.
Figure 4:
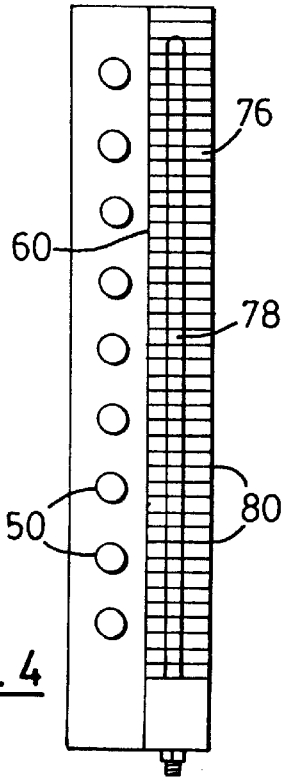
FIG. 4 is a cross-sectional view of the induction unit taken along the line IV—IV of FIG. 1.

Each induction unit also has an elongate, horizontally extending air plenum section 44 mounted at an upper end of the air mixing chamber and having a primary air inlet 46 formed therein at one end. The air inlet may be formed with a connecting flange 49 as illustrated in FIG. 2. The plenum section forms an elongate, box-shaped plenum chamber 48.

One or more rows of air nozzles 50 extend into the air mixing chamber 38 and are mounted on a side 52 of the air plenum section. Each air nozzle 50 has an inlet end 54 that is open to the primary air high pressure interior chamber or plenum chamber 48. In the induction units 32 and 34 of FIG. 1 there is one row of the nozzles 50 in each unit but in the induction unit 34*b* of FIG. 2 there are two rows of nozzles arranged side-by-side. These rows extend horizontally and preferably the nozzles are arranged at an acute angle to the horizontal as illustrated in FIG. 1. A narrow passageway formed in each nozzle tapers inwardly from the inlet end 54 to a nozzle outlet 56. In the preferred embodiment, the nozzles are made of plastic, for example polyethylene or they can be made of metal such as bronze. If they are made of plastic they should be capable of withstanding elevated temperatures of as much as 160° F. and more. The nozzle opening at the inlet end 54 in a preferred embodiment has a diameter of ¾" and the discharge outlet of the nozzle has a diameter between ¼ and ⅜ths inch. This preferred nozzle causes only a low noise level during the operation of the induction unit. It will be appreciated that the size, shape, and number of nozzles in the induction unit can be varied by the system installer in order to meet the air handling requirements of the particular building. Furthermore, the nozzles in one of the induction units can be different from the nozzles of the other unit in order to provide different airflows from the two induction units. In other words, the system can be customized to suit and meet the requirements in the room above which the induction units are installed.

Figure 5:
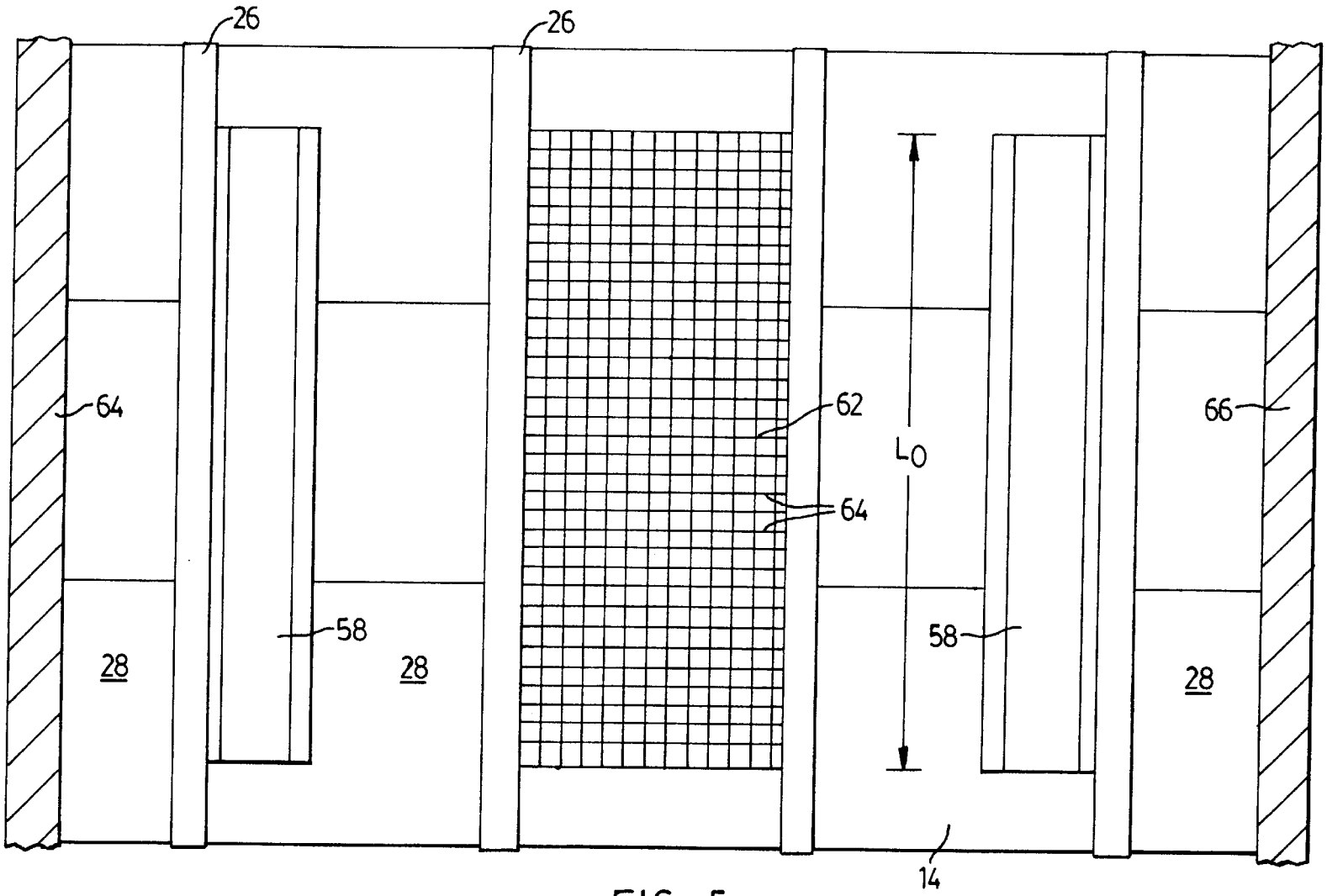
FIG. 5 is a bottom view taken along the line V—V of FIG. 1 showing the ceiling of the enclosed space.

The air mixing section 36 has a long, narrow air outlet 58 formed at a lower end thereof. In one preferred embodiment, the width of the air outlet is approximately 4 inches whereas the length $L_o$ indicated in FIG. 5 is about 4 feet. It will be appreciated that two or more pairs of the induction units as illustrated in FIG. 1 can be arranged along the length of the room, the number of pairs used depending upon the size and length of the room or enclosed space. These pairs of induction units can be arranged in one or more rows above the ceiling 14.

A side air inlet 60 permits return air from the enclosed space or room 16 to flow through a side of the air mixing section 36 and into the air mixing chamber 38. Arrows indicating the upward flow of return air RA through a perforated grate or panel 62 are shown in FIG. 1. The panel 62 can be of standard, rectangular construction and can have reasonably large openings 64 formed therein for easy passage of the return air. It will be understood that, during use of this system, the return air is drawn by a venturi effect created by the nozzles 50 into each air mixing chamber 38. In this way, the induction unit 32, 34 is capable of delivering a mixture of primary air, that passes through the plenum section 44 and the nozzles 50, and return air through its air outlet 58 to the enclosed air space.

As indicated, the air handling system has two induction units 32 and 34 mounted above the ceiling 14 with the air mixing section 36 extending at a substantial acute angle to the ceiling 14 and at a substantial angle to the air mixing section of the other induction unit as shown in FIG. 1. In the illustrated preferred embodiment, the substantial acute angle between the air mixing section 36, in particular the two opposing side walls 40 and 42 thereof, and the ceiling is 45 degrees approximately, while the substantial angle between the two air mixing sections of the two induction units is 90 degrees approximately. Because of the 45 degree slope of each air mixing section, the airflow passing out through each air outlet 58 is generally downwardly and outwardly away from the center of the room. It will be appreciated that the centerline C of the room can be aligned with the center of the pair of induction units located at the apex point A. The centerline of the room is in a vertical plane midway between two opposing vertical walls 64 and 66 which are part of the building 12 and which define two of the vertical sides of the enclosed space 16. However, if the vertical walls 64, 66 are located a reasonable distance from, for example two to three feet, from their adjacent respective air outlets 58, then the downward airflow from the air outlet will flow out to the vertical wall and then be directed downwardly towards the floor by the vertical wall. This can result in a circulation pattern for the air which can provide for fresh conditioned air in all regions of the enclosed space or room. It will be appreciated that after the airflow passes down along the vertical wall 64 or 66, it will then turn at the floor of the room and circulate back to the center of the room where it meets the opposite air flow and then passes upwardly to the ceiling and through the centrally located perforated panel 62. It will be further appreciated that one of the walls 64 or 66 can be an outside wall with windows mounted therein while the opposite wall can be an inside wall. Thus the heating or cooling demands on one induction unit can be quite different from the demands on the other induction unit. Accordingly, the two induction units can be made differently so as to handle these different requirements.

There are supporting members for mounting each induction unit, 32, 34 so that the air mixing section 36 extends at a substantially acute angle to and down to the ceiling 14 and so that the air outlet 58 is positioned where the air mixing section 36 meets the ceiling 14. It will be readily apparent to one skilled in the art that each induction unit can be supported rigidly in a variety of ways. In the illustrated embodiment of FIG. 1, there are vertically extending support frames 68 and 70 that extend down from the structural ceiling 20 and that are connected thereto. In FIG. 1, one of the frame members 70 is only shown in part for ease of illustration but it will be understood that it can be similar to the frame 68. The bottom end of each frame member 68, 70 is connected by means of connecting flange 72 and bolts to the upper sidewall of the air mixing section 36. Although only one of each of the vertical frame members 68 and 70 is shown in FIG. 1, it will be appreciated that there will normally be at least two of the frame members 68 and at least two of the frame members 70 with two of these frame members being located at opposite ends of the air mixing section. There is an additional frame support in the form of an elongate angle member 74 which not only joins together the two plenum sections 44 but also supports the induction units at this central location. It will be appreciated that the angle member 74 can either extend horizontally to vertical support walls (if sufficiently close) or it can in turn be connected by vertical frame members (not shown) to the structural ceiling 20. Additional support frames can be provided if desired or if required in order to rigidly and securely support the two induction units.

Preferably a heat exchanging coil unit 76 is mounted adjacent to the downwardly facing sidewall 40 of each induction unit within the region of the side air inlet 60. The length and width of the heat exchanging coil unit can correspond approximately to the length and width of the rectangular air inlet 60 in order to achieve the fill benefits of the heat exchanging coil unit but the coil unit can be made smaller if a larger one is not required to satisfy the heating or cooling requirements for that induction unit. The return air flowing through the side air inlet 60 first passes through the coil unit in order to be heated or cooled thereby. Each coil unit can per se be of known construction and can comprise a series of coolant pipes 78 that are arranged in a row and a number of closely spaced heat exchanging metal fins 80 that are parallel and that extend perpendicular to the sidewall 40. The fins 80 are connected to the coolant pipes 78 for a good heat transfer therebetween. Thus the return air can easily flow between the fins or plates 80 to pass through the air inlet 60. The heat exchanging unit 76 is mounted on the outside of the air mixing section in order not to interfere with the mixing of the air and the flow of air through the air mixing chamber.

In a preferred embodiment of the heat exchanging unit 76, the coolant pipes are made of copper tubes and the thin plates or fins 80 are made of aluminum. The coolant tube should be suitable for a working pressure of up to 350 psig. Preferably there is provided at the lower end of each heat exchanging unit 76 a horizontally extending condensate pan or tray 82 in order to prevent condensate created by the heat exchanging unit from dripping down through the ceiling 14. The pan 82 can either be non drainable or can be drained by a suitable tube connection (not shown).

Preferably, since the primary air entering the plenum section may be quite cool, one, two or more sides of the air plenum section 44 can be covered with a thick layer of insulating material 90, for example, a flexible layer of neoprene. In the preferred embodiment illustrated in FIG. 1, the neoprene extends along the two upwardly facing sides of the air plenum section. In order to conduct primary air for each or both of the air plenum sections 44, there can be provided an elongate air duct 92 which is connected to the primary air inlet 46. For ease of illustration, only a portion of the air duct 92 is illustrated in FIG. 1. The air duct can either be a flexible tube type duct (which may be required if the duct must pass around a number of obstacles) or it can be a rigid sheet metal air duct of known construction. It will be appreciated that the air duct extends to a source of primary air indicated generally at 94. For example, it can extend to an outer wall of the building where an opening in the wall permits outside air to flow in. In order to supply two separate air plenum sections 44, a Y-type connection can be provided in the air duct in the vicinity of the air plenum sections 44. This arrangement has the advantage of providing a balanced supply of air to the two induction units resulting in an equal amount of primary air (and return air) flowing through the two induction units and out of the air outlets 58. In the illustrated embodiment of FIG. 1, a variable air valve 96 which per se is of known construction is connected to the air duct and is capable of controlling the volume or primary air flowing into the two induction units. Preferably the air valve is a pressure independent type valve. Such a valve is shown and described in Canadian patent No. 1,237,359 issued May 31, 1988. The description and drawings of this Canadian patent are incorporated herein by reference.

It is also possible to provide a variable air volume control device located inside the induction unit itself and in particular inside the air plenum section 44. An air control device of this type is illustrated in FIG. 2, the device including an adjustable air flow restricting plate 100, the position of which is controlled by a control rod 102 that passes through an elongate, straight, slot 104 formed in the plate 100. By reason of nuts threaded onto the rod 102 and located on opposite sides of the plate 100, axial movement of the rod 102 can cause the plate 100 to pivot about hinges located at one end of the plate. By pivoting the plate 100 towards the sidewall 108 of the plenum section, the flow of primary air can be reduced and vice versa. Axial movement of the rod 102 can be accomplished manually or by means of a standard electrical linear actuator.

It will be seen from FIG. 5 that in the preferred, illustrated embodiment the two air outlets 58 form elongate, narrow slots and are parallel to one another. In one preferred embodiment they are spaced apart by a distance of at least three feet and in particular a distance of 3 feet, 4 inches. In this preferred embodiment, the height of the apex A (FIG. 1) above the ceiling 14 was approximately one foot six inches. It will be appreciated that because of the substantial slope of the two induction units, the overall height of the pair of induction units is reasonably small. The result is that the height of the space 18 above the hanging ceiling 14 need not be excessive, for example about two feet in the preferred embodiment. At the same time, the length of the air mixing chamber L can still be quite long permitting both good mixing of the two air flows and good static pressure regain.

It will also be noted that the aforementioned grill or panel 62 can be simply supported on two or more T-bars 26. The grill can thus be readily removed to permit easy servicing of the induction units or the heat exchanger units.

One substantial advantage gained with the air handling system of the invention as described herein is the reduction in the primary air capacity that can be achieved. The amount of primary air required to supply a given size of enclosed space can be reduced by as much as 70% compared to a conventional air supply system.

It will be appreciated that although the configuration and arrangement of the induction units is preferably that illustrated in FIG. 1, it is also quite possible to arrange the induction units differently while still achieving some of the aforementioned advantages.

Figure 6:
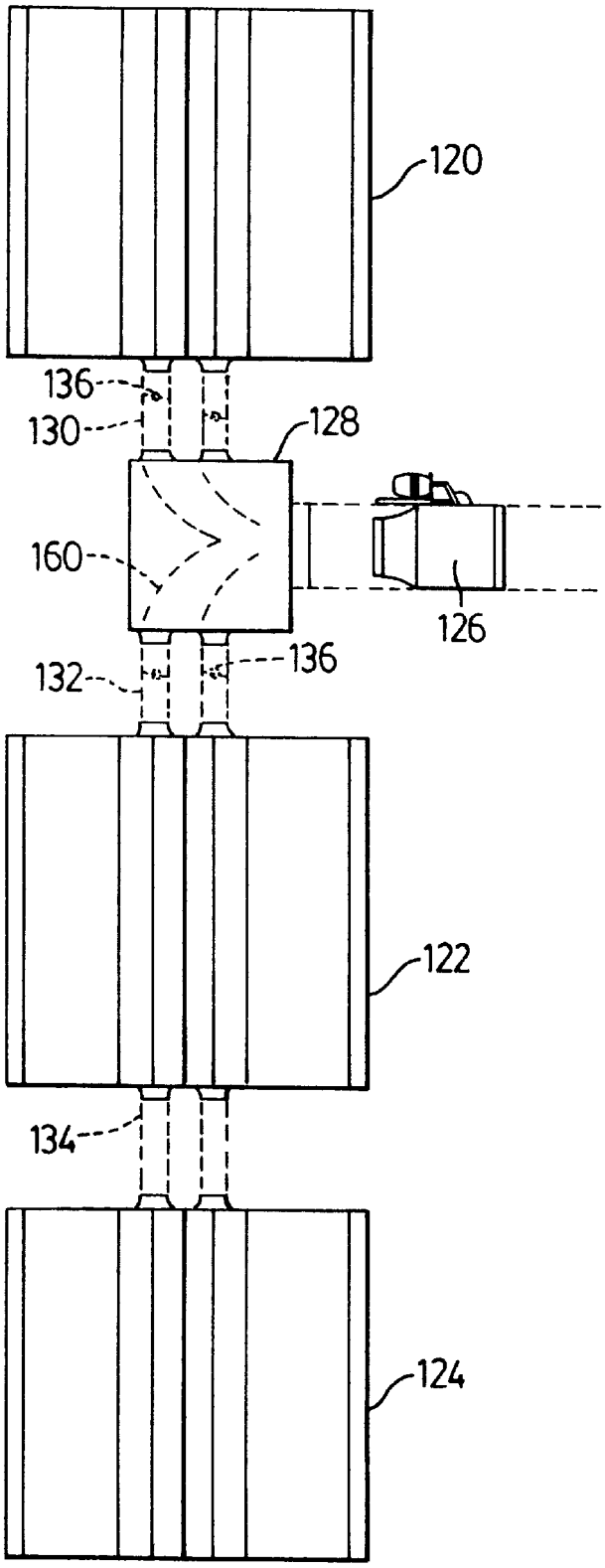
FIG. 6 is a schematic plan view illustrating how three pairs of induction units can be connected to a single air valve.

FIG. 6 illustrates in plan view a possible arrangement of three of the above described air handling systems with each system comprising a pair of induction units. The illustrated system may be suitable, for example, for a classroom area of the usual size. In FIG. 6 the three pairs of induction units are indicated at 120, 122 and 124. Primary air is delivered to all three pairs of induction units through a single VAV valve 126 which again can be of known construction. This air valve delivers the primary air to a suitable distribution box 128 which, in a known manner, can contain baffles 160 in order to evenly and smoothly deliver the primary air to smaller air ducts 130 and 132. As illustrated, there are two ducts 130, one for each of the induction units of the air handling apparatus 120 and two ducts 132, one for each of the induction units of the pair 122. It will be appreciated that the pairs 124 and 122 of induction units are connected in series and that some of the air that is delivered to the air plenum sections of the pair 122 is passed on to the air plenum sections of the pair 124 by means of further air ducts 134. Preferably, each of the air ducts 130, 132 is fitted with a standard, adjustable air damper indicated at 136. Thus the amount of primary flow flowing through each of the ducts 130, 132 from the distribution box can be adjusted by the installer or maintenance staff, as required. It will also be understood that, in the usual case, twice the volume of air will be delivered to and passed through the air ducts 132 as will pass through the air ducts 130 in order to achieve a reasonably even distribution of a mixed airflow in the room above which these units have been installed. The distribution box 128 is preferably reasonably large. The construction of a distribution box of this type is per se well known in the air distribution industry and accordingly a detailed description thereof herein is deemed unnecessary. The size of the distribution box and the baffles are arranged so as to reduce the pressure loss in the distribution box. Because of the desirability of reducing pressure loss as much as reasonably possible, it will be understood that the distribution box or plenum 128 can be aerocoustically designed in a manner known in the air distribution art.

It will be further appreciated by those skilled in the art that an air handling system constructed in accordance with the invention, for example a system designed for a school classroom, could be controlled with a known type of electrical control unit that provides for more than one mode of operation by the air handling system, for example, two different settings. The control unit can be set up so that there is a certain setting for when the room is occupied (in which case the air handling requirements will normally be greater) and another setting that would be used when the room is normally unoccupied. The electrical control unit can be set up to operate a two position air valve with each position of the valve representing one of these two settings. Again, the design of such a control system is well within the skill of those in the air handling industry and accordingly a detailed description herein is deemed unnecessary.

Figure 7:
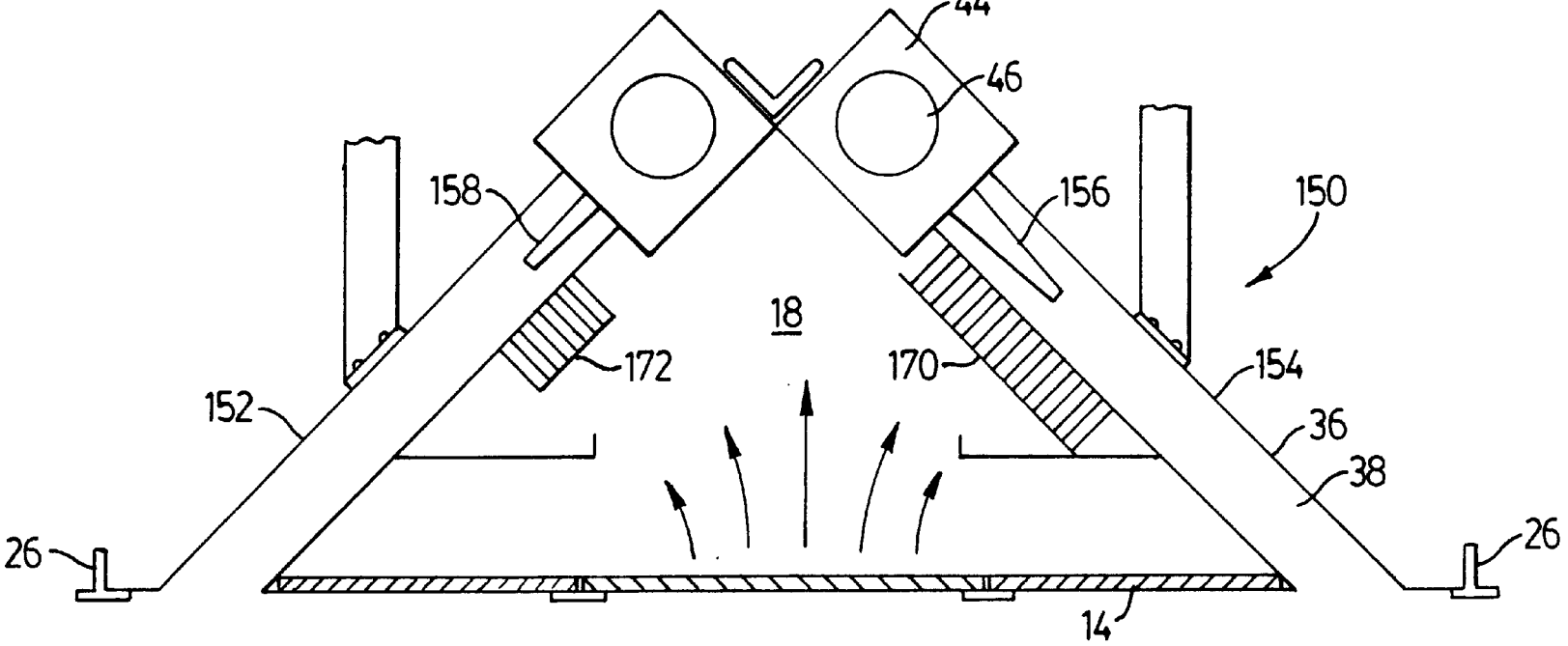
FIG. 7 is a schematic cross-sectional elevation similar to FIG. 1 but illustrating another embodiment of the air handling system.

FIG. 7 of the drawings illustrates schematically how an air handling system 150 constructed in accordance with the invention can be set up with two different induction units 152, 154. For example, as illustrated in FIG. 7, the series of nozzles 156 in the induction unit 154 can be made larger than the series of nozzles 158 in the induction unit 152. By using larger nozzles in the unit 154, it is possible to deliver a larger amount of primary air to the right induction unit 154 as compared to the amount delivered to the left unit. One situation where the use of different induction units constructed in this manner might be appropriate is when the right side unit 154 delivers its airflow to an exterior wall of the room which has windows extending along the wall while the left hand unit is delivering its airflow to an opposing inside wall of the room which is located in an area of the room that generally requires less heating or less cooling than provided by the right side unit 154. FIG. 7 also illustrates the possibility of having different heat exchanging coil units 170 and 172 for the two induction units. As illustrated, the heat exchanging coil unit 170 for the induction unit 154 is larger in size and in heating or cooling capacity than the heat exchanging coil unit 172 of the induction unit 152. The reason for this difference again can arise from the fact that different regions in the room can have quite different heating or cooling requirements. Generally these requirements can be estimated by the air handling engineer prior to the manufacture and installation of the air handling apparatus of the invention. Once these different requirements have been calculated, the manufacturer of the air handling apparatus can then readily design the two induction units to meet the particular requirements of the room or other enclosed space.

It will also be appreciated that in some cases there may be no need for a heating exchanging coil unit on one of the two inductions units while there is a need for a heat exchanging coil unit on the other induction unit. For example, the region of a room adjacent an interior wall may require very little or no additional heating or cooling to be provided by the air handling apparatus in the ceiling. The heating or cooling provided by a central heating or air conditioning unit of the building (from which the primary air is delivered) may be calculated to be quite sufficient for interior areas of the building including areas adjacent the interior walls.

In some applications, one of the induction units can be set up so that its heat exchanger unit will only provide cooling air, for example to an inner region of the room, while the other induction unit is provided with a heat exchanger capable of providing either cooled air or warmed air to another region of the room, for example, a perimeter area adjacent an exterior wall. Depending on expected outside climate conditions and other factors such as adjacent rooms, hallways, etc., the air handling engineer may determine that an interior region of the room will likely never require additional heating from the ceiling mounted air handling system but may, for example in mid-summer, require additional cooling to be provided by its respective induction unit.

Also, for some applications it may not be desirable or necessary to mount the one or more pairs of induction units along the centerline of the ceiling. In some applications, the air handling engineer may determine that the one or more pairs of induction units should be mounted closer to one wall of the room, for example, a wall having several windows mounted therein. Such an arrangement will provide a greater airflow in the region of the room adjacent the windows and a smaller airflow to an inner region of the room where it has been determined that less airflow will still be sufficient.

It is possible to connect more than one pairs of the induction units constructed in accordance with the invention either by means of a parallel connection or by means of a series connection. In the case of a parallel type connection where the primary airflow is delivered by separate air ducts to each pair, it is possible to connect any required number of the induction units in the ceiling and still deliver sufficient primary air to each pair of induction units. However, with a series type connection where the primary air flow is delivered through a single air duct arrangement to the pairs of induction units, the user of such a system is limited by the capacity of the air duct to deliver sufficient primary air to the pairs of induction units. In some cases, for example, it may only be possible to connect two pairs of induction units in series (see the arrangement of the induction units 122, 124 illustrated in FIG. 6).

Although FIGS. 1 and 7 illustrate a pair of induction units mounted above the level of the ceiling 14, it will be appreciated that these induction units can also be mounted below but adjacent to the ceiling of the room, if desired. In the latter case, the space between the two outlet slots can either be left open or can be covered on the bottom by means of a suitable grill similar to that illustrated in FIGS. 1 and 7 or integrally connected to the bottom ends of the two induction units.

The air handling system of the present invention can also be constructed so that one of the two induction units provides a constant volume air supply with the possibility of varying the air temperature to a perimeter zone in a room while the other induction unit provides a constant temperature, variable air volume supply in order to make up for interior ventilation exhaust, for example, for a laboratory hood. Another possible arrangement for the air handling system is to have one of the induction units capable of providing a variable air volume air supply, the temperature of which may or may not be variable, to a perimeter area of the room while the other induction unit provides a constant volume air supply, the temperature of which can be adjusted, to the interior of the room which might, for example, be a conference or lecture room.

It will also be understood that with respect to the heat exchanging coil units 76, in the usual situation these units will employ a number of secondary water coils through which water flows to either cool or heat the return air. It will be understood that these heat exchanging units which can per se be of standard construction can vary with respect to the number and arrangement of the secondary water coils and these coils can be piped in parallel or series.

It will further be appreciated by those skilled in this art that the air handling system of the invention can be used with induction changeover two pipe, induction non-changeover two pipe, or induction four pipe systems, all of which are known per se in the air handling art. In an induction changeover two pipe system, a change in the supply of water to the heat exchanging units is often carried out simply by closing or opening a suitable valve which can be done manually. After the changeover, for example in the fall, the heat exchanger units 76 can be used for heating while, after the changeover in the spring, the heat exchangers can be used for cooling. In the case of an induction non-changeover two pipe system, there is generally a central heating system that is capable of heating the air to a temperature in the range of 55 to 90 degrees F. and this central system that is capable of providing air of this temperature year round. In this system, the heat exchanger units on the induction units can simply be used to reheat the return air, when required.

In the four pipe system there are two separate heat exchanger units mounted on one or both of the induction units with one of the heat exchanger units providing heating when required and the other heat exchanger unit providing cooling.

In the majority of installations employing the air handling system of the present invention, the primary air supplied to the induction units will first be dehumidified and cooled in a central air apparatus installed at a suitable location in the building. The cooling-dehumidifying coil of this central air apparatus should precede the zone or building reheat coil. The latter may be required, depending on climatic conditions and the percentage of outside air. A humidifier may also be provided in the air supply system, preferably at the location of the central air apparatus.

In the case of air conditioned applications employing the present air handling system and a VAV valve, the valve controller should be deactivated by the user as a first step in providing for cool down and dehumidification after night shut-down of the system in order to avoid condensation problems. The VAV valve controller must be shut off as it is only temperature sensitive.

The present air handling system permits a wide range of possible arrangements of the two induction units permitting the present system to be adapted for various applications requiring a supply of air to an enclosed space. Suitable amounts of air can be provided through the horizontally extending slots of the two induction units at the required IAQ criteria for the particular room area being served.

It will be appreciated by those skilled in air handling systems that various modifications and changes can be made to the illustrated and described air handling system without departing from the spirit and scope of this invention. Accordingly, all such modifications of the air handling system as fall within the scope of the appended claims are intended to be part of this invention.

What is claimed is:

1. An air handling system for a building having a horizontally extending ceiling and an enclosed space below said ceiling, said system comprising:

two induction units adapted for mounting adjacent said ceiling, each of said units having an air mixing section forming a relatively long air mixing chamber, an elongate, horizontally extending air plenum section mounted at an upper end of said air mixing chamber and having a primary air inlet formed therein, and air nozzles extending into said air mixing chamber and mounted on a side of said air plenum section, said air nozzles having each an inlet end opening into an interior chamber of said air plenum section, wherein said air mixing section has an air outlet formed at a lower end thereof and a side air inlet for permitting return air to flow through a side of said air mixing section and into said air mixing chamber; and supporting members for mounting said two induction units so that each air mixing section extends at a substantial acute angle to said ceiling and is located adjacent said ceiling during use of the system in the building, wherein during use of said system, said return air is drawn by a venturi effect created by said nozzles into each air mixing chamber and said two induction units are capable of delivering a mixture of primary air, that passes through their plenum sections and said nozzles, and return air through the air outlets to said enclosed air space.

2. An air handling system according to claim 1 including a heat exchanging coil unit mounted adjacent to said side of each air mixing section, wherein said return air flowing through each side air inlet first passes through the respective coil unit in order to be heated or cooled thereby.

3. An air handling unit according to claim 1 including an elongate air duct connected to the primary air inlet of each induction unit and a variable air valve connected to said air duct and capable of controlling the volume of primary air flowing into the two induction units.

4. An air handling unit according to claim 3 wherein said air valve is pressure independent.

5. An air handling unit according to claim 1 wherein said two induction units are mounted so as to extend substantially perpendicularly to one another and each air mixing section extends at an angle of about 45 degrees to the ceiling.

6. An air handling unit according to claim 2 wherein said air nozzles are arranged in one or more horizontally extending rows and an air passageway formed in each nozzle tapers inwardly from said inlet end to a nozzle outlet in the air mixing chamber.

7. An air handling unit according to claim 2 wherein the two air outlets of the induction units are elongate and parallel to one another and are spaced apart by a distance of at least three feet.

8. An air handling apparatus for a building having an enclosed space, said apparatus comprising:

two induction units adapted for mounting in a ceiling adjacent the enclosed space, each induction unit including an air plenum section with a primary air inlet, an air mixing section connected to a side of said air plenum section and forming an elongate air mixing chamber extending in a direction away from said air plenum section, and a series of air nozzles mounted on said side of said air plenum section and extending into said air mixing chamber, each air mixing section having an air outlet in an end thereof furthest from said air plenum section and a side air inlet for permitting return air to flow through a side of said air mixing section in the region of said nozzles; and supporting members for mounting said two induction units so that they are adjacent one another and so that each air mixing section extends at a substantial acute angle to a horizontal plane which, during use of said apparatus, is located at or near the ceiling;

one or more variable air volume control devices adapted to control the volume of primary air passing through the air plenum sections and through the series of air nozzles, wherein during use of said apparatus, said return air is drawn by venturi effect created by a fast flow of primary air from said nozzles into each air mixing chamber and said induction units are capable of providing airflows comprising a mixture of said primary air and return air at said air outlets.

9. An air handling apparatus according to claim 8 wherein the series of air nozzles of one induction unit are different than the series of nozzles in the other induction unit in order to provide different airflow delivery capabilities between the two induction units.

10. An air handling apparatus according to claim 8 wherein a heat exchanging coil unit is mounted adjacent each side air inlet and outside the adjacent air mixing chamber, each coil unit being provided to heat or cool return air flowing through its respective air inlet during use of said apparatus.

11. An air handling apparatus according to claim 10 including an elongate air duct connected to each primary air inlet and adapted to extend to a source of primary air, wherein said one or more air volume control devices comprise a variable air valve connected to said air duct at a location spaced away from said induction units.

12. An air handling system according to claim 10 wherein said one or more air volume control devices are adjustable air dampers mounted within the air plenum sections.

13. The combination of a building structure having an enclosed space and an air handling system capable of providing a mixture of primary air and return air to said enclosed space, said combination comprising:

a horizontally extending ceiling and walls forming said building structure and defining said enclosed space;

two induction units mounted adjacent said ceiling, each induction unit having an air plenum section having a primary air inlet, an air mixing section forming an air mixing chamber and mounted on a side of the air plenum section, air nozzles extending into said air mixing chamber and mounted on said side of the air plenum section, said air nozzles each having an inlet end that is open to a primary air high pressure plenum chamber in said air plenum section, and a side return air inlet in one side of said air mixing section for permitting return air to flow into said air mixing chamber from said enclosed space, said air mixing section having an air outlet at an end thereof furthest from its air plenum section; and supporting frame members mounting said two induction units adjacent said ceiling so that each air mixing section extends down from said air plenum section to its air outlet and extends at an acute angle to said ceiling, wherein during use of said system, said return air from said enclosed space is drawn by a venturi effect created by said nozzles into each air mixing chamber and said two induction units deliver said mixture of primary air and return air through their air outlets to said enclosed space.

14. The combination of claim 13 including an elongate air duct system connected to said primary air inlet of each induction unit and arranged to provide a substantially balanced amount of primary air to said induction units and at least one variable air volume control device capable of adjusting the amount of primary air passing through the two induction units.

15. The combination of claim 13 wherein each induction unit has a heat exchanging coil unit mounted adjacent to said side return air inlet and provided for heating or cooling said return air.

16. The combination of claim 15 wherein said two induction units are mounted adjacent one another and so that their two air mixing sections are substantially perpendicular to one another with each air mixing section extending at an angle of about 45 degrees to said ceiling.

17. The combination of claim 14 wherein said at least one air volume control device is a single air valve which is pressure independent.

18. The combination of claim 15 wherein the heat exchanging coil unit of one induction unit is larger in size and in heating or cooling capacity than the heat exchanging coil unit of the other induction unit.

19. The combination of claim 15 wherein the size of the air nozzles in one induction unit is larger than the size of the air nozzles in the other induction unit so that the amount of primary air flowing through said one induction unit is greater than the amount flowing through the other induction unit.

* * * * *